United States Patent [19]

Conjura

[11] 4,278,017

[45] Jul. 14, 1981

[54] CONVERTIBLE SEAL PRESS

[75] Inventor: Walter E. Conjura, Berwyn, Ill.

[73] Assignee: Cosco Industries, Inc., Spring Valley, N.Y.

[21] Appl. No.: 40,519

[22] Filed: May 21, 1979

[51] Int. Cl.[3] ..... B42B 25/06

[52] U.S. Cl. ..... 101/3 SP; 227/156; 227/134

[58] Field of Search ..... 248/645, 678; 227/156, 227/120, 134, 150; 101/3 SP; 24/255 R, 73 PF

[56] References Cited

U.S. PATENT DOCUMENTS

| | | | |
|---|---|---|---|
| 1,346,150 | 7/1920 | Willard | 101/35 P |
| 1,619,959 | 3/1927 | Sasseman | 101/3 SP |
| 2,080,987 | 5/1937 | Priesmeyer | 101/3 SP |
| 2,147,380 | 2/1939 | Peterson | 227/134 |
| 2,239,935 | 4/1941 | Scherman | 227/134 |
| 2,281,198 | 4/1942 | Maynard | 227/134 |
| 2,702,383 | 2/1955 | Buechler | 227/134 |
| 2,859,443 | 11/1958 | Jopp | 227/124 |
| 3,083,367 | 4/1963 | Ruskin | 227/134 |
| 3,313,231 | 4/1967 | Priesmeyer et al. | 101/16 |
| 3,809,799 | 5/1974 | Taylor | 24/255 R |
| 3,979,796 | 9/1976 | MacDonald | 24/73 PF |
| 4,014,493 | 3/1977 | Wolf | 227/156 |

FOREIGN PATENT DOCUMENTS

| | | | |
|---|---|---|---|
| 209858 | 6/1960 | Austria | 227/156 |

*Primary Examiner*—William Pieprz

*Attorney, Agent, or Firm*—Senniger, Powers, Leavitt and Roedel

[57] ABSTRACT

A base for supporting a pocket seal press having a bottom, the base having a recess therein adapted to receive the bottom of the seal press with the bottom of the seal press bearing on the bottom of the recess, the bottom of the recess having an opening therein. The base further comprises a latch at the opening in the bottom of the recess for detachably securing the seal press to the base, the latch normally occupying a first position in which the latch is engageable with the seal press for holding the seal in the recess of the base and being accessible from beneath the base for being moved to a second position enabling removal of the seal press from the recess in the base. The combination of a base and a pocket seal press is also disclosed.

26 Claims, 7 Drawing Figures

CONVERTIBLE SEAL PRESS

BACKGROUND OF THE INVENTION

Priesmeyer, a leader in seal press constructions, as shown in one of his patents, U.S. Pat. No. 2,080,987, provided convertibility of a portable pocket seal press to a desk top seal press by horizontally sliding a pedestal member onto the seal end of the pocket seal press under the seal, the grip-end of the bottom of the seal press being bent downward so that the bottom of the seal press is level with the bottom of the pedestal when both rest on a desk top.

However, if, manual embossing pressure is not carefully applied vertically on the handle above the grip end of the frame, the vertical press could tip and slide, thereby scarring the table top, injuring the fingers of the user, and damaging the document being embossed.

Furthermore, it was not readily perceivable by an occasional user of an embossing seal press, such as a pocket seal press, how this conversion or a restoration of the Priesmeyer desk seal press as a pocket seal press was, or could be accomplished regardless of its serving as a pocket or desk seal press at any particular time. In fact, in order to provide the dual use, Priesmeyer constructed his seal so that the "desk" seal press could be carried and handled as a "pocket" seal press regardless of the conversion because once converted to a desk operation and used that way for any length of time, it would not be readily remembered or understood by an irate user how the "pocket seal press" status could be restored.

Also, although the pushing, pulling and twisting of the cylindrical pedestal on the press frame disposed under the seal die might be easily examined, a concealed detent lock employed to hold the die and counter die in registration effectively discouraged experimental investigation for removal. On the other hand, if and when removed, and lost or misplaced, the puzzle of finding the pedestal and correctly remounting it arose.

The busy seal press user does not want to be required to take time and think, or be confused, as to how a base is attached or detached, nor try to remember, nor look for instructions.

As objects of the invention, a convertible seal press structure is provided which is suggestive of its mode of assembly and its mode of movement and operation, particularly as a matter of instinctive considerations of persons other than engineers using the device. This is highly desirable where the product is sold as a desk seal and its convertibility may not have been explained, or vice-versa. Then an owner has to overcome the concealed snap in order to move the base support endwise. In fact, the base support actually looks like a permanent rigid part of the seal press frame, and when used, to reinsert it carefully in proper position takes an appreciable degree of skill.

Moreover, it is desirable to have a seal press, such as a notary seal press, that can be carried in a pocket, or brief case, without a base, and, optionally be supported on a base to serve as a desk seal press. For these purposes the natural habits of users should be accommodated to avoid annoyances and provide easy and instant convertibility by the user without any delay between desk and pocket seal press versions, and such should be accomplished without tools and undue strains upon assembled elements.

OBJECT OF THE INVENTION

Not only in the office or home where a number of paper embossing seals may be kept, but also in shops selling and servicing seal presses, it is highly desirable to have a seal press which readily utilizes any one of a number of die assemblies of different sizes and shapes. In offices several die assemblies can be stored in small spaces for safe keeping and operated interchangably in a single press frame. Moreover an object of this invention is to provide a press frame that can be readily converted from a hand carried pocket seal press to a desk seal press. Furthermore, in either mode of operation the die assembly is capable of shifting to adjust its position with respect to the frame within limits predetermined by the element by which embossing pressure is transmitted. Alternately a rolling member may be provided which interengages one die element of the assembly in latching relationship regardless of whether or not the die elements are round or rectangular.

Not only is it preferred that the die elements be movable as a unit and adjusted as to rotational orientation but also that they be removable from the manually operated frame whether the frame is portable or is releasably carried on a stationary base. Also, it is an object of this invention that the die elements be resiliently related to each other for coincidence so that sharp impressions may be made in the document, even after the die elements are worn, with the final forming pressure being spread uniformly over the entire die or press area.

Generally considered, the seal press incorporating the invention that is herein disclosed for purposes of illustration includes a removable unitary die assembly for the upper and lower die elements with the supporting element including a spring disposed to urge separation of the die elements. The unitary assembly is readily installed in a throated two sided seal press having a handle or lever carrying a roller operable to close the die elements and apply embossing pressures thereon.

SUMMARY OF THE INVENTION

In the present invention, a further advantage accrues. Not only is the inventory of seal presses for portable use, and for desk use reduced to one model, but either use can be made alternately thereof and quickly with the use of a light weight inexpensive base that can be readily attached or detached merely by applying or removing it with natural manipulation. Moreover, the base provides a large supporting area providing stability to the seal press when used as a desk seal press.

The invention also contemplates that in attaching the pocket seal press to the base the handle end or heel of the seal press is obviously insertible in the only end of an upwardly opening recess in the base which will receive it, and the other end of the seal press is adapted to be pressed downwardly with a light pressure into engagement with, a yielding latch-like element at the other end of the recess which resiliently holds the forward end of the pocket seal press in operative position in the base for operation as a desk seal press. This attachment is accomplished by inserting the heel of the seal press into the base and pivoting the pocket seal press about its heel toward the base to move the seal press into the recess in the base and into engagement with the latch.

Furthermore, whereas in earlier endeavors, the rear end portion of the bottom of the seal press had to be deformed downwardly, as described above, to support the converted seal press against tipping or tilting as a desk seal press, another object of the present invention is that the seal press is adapted to, be supported on a plastic base over a table top area approximately three times that of the area of the bottom of the pocket seal press alone.

IN THE DRAWINGS

DESCRIPTION OF A PREFERRED EMBODIMENT

Figure 1:
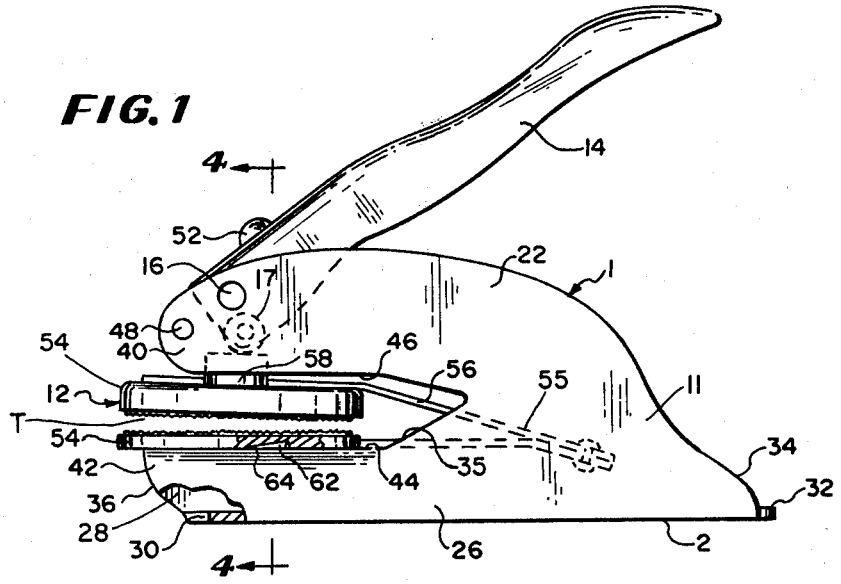
FIG. 1 is a side elevation of a pocket seal press as it appears for manual grip support and operation ready to emboss an impression on a document.
Figure 2:
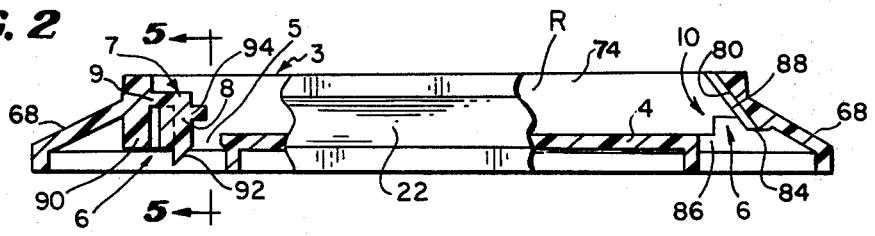
FIG. 2 is a side elevation of a base of this invention having a recess adapted to receive the bottom of the seal press.
Figure 3:
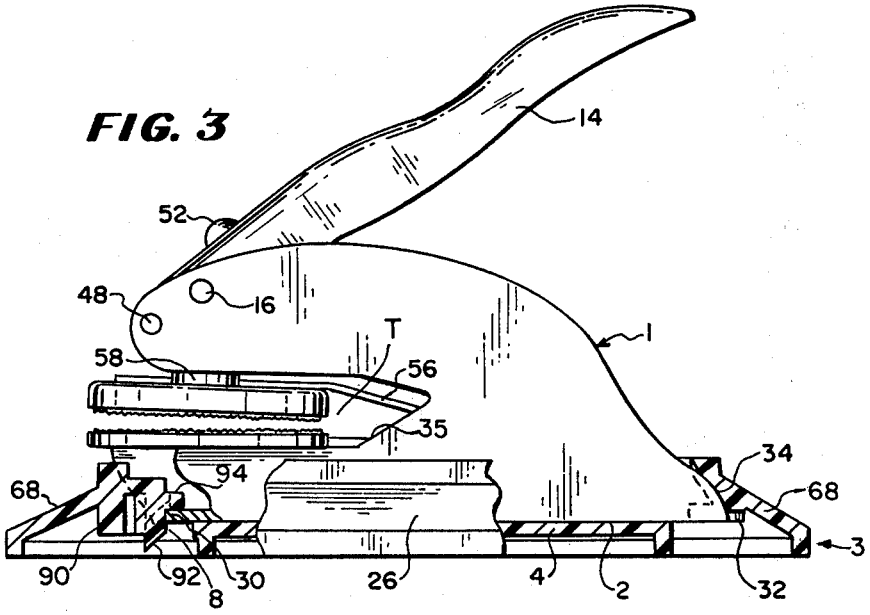
FIG. 3 is a side elevation of the pocket seal press in the base with portions shown in section.

Referring to the drawings, there is generally indicated at 1 a pocket seal press having a bottom 2, and a base 3 for supporting the seal press 1 in an upright position. The base has a recess R therein adapted to receive the bottom 2 of the seal press with the bottom of the seal press bearing on the bottom 4 of the recess, the bottom of the recess having an opening 5 therein. The seal press 1 and the base 3 have means 6 for detachably securing the seal press to the base comprising a latch 7 at the opening 5 in the bottom of the recess. The latch 7 normally occupies a first position for holding the seal press 1 in the recess R in the base 3 and is accessible from beneath the base for being moved to a second position enabling removal of the seal press 1 from the recess in the base. The latch 7 comprises a finger 8 secured by a resilient hinge member 9 to the forward end wall of the recess R. The securing means 6 further comprises means 10 at the rear end of the recess engageable with the seal press 1 at the heel thereof for holding the seal press in the recess. The pocket seal press 1 is constructed generally of three units; a press frame 11, a unitary embossing die assembly 12, and a manually actuated lever 14 pivotally mounted on the frame 11 by a pivot pin 16, the lever having a roller 17 rotatably mounted thereon for actuating the embossing die assembly 12.

Figure 4:
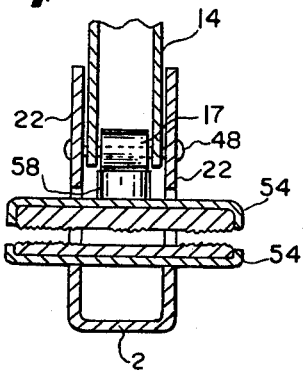
FIG. 4 is a vertical section of the pocket seal press on line 4—4 of FIG. 1.
Figure 5:
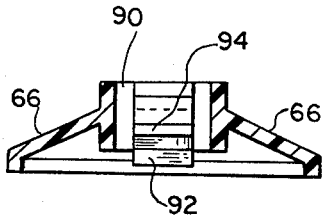
FIG. 5 is a vertical section of the base on line 5—5 in FIG. 2.
Figure 6:
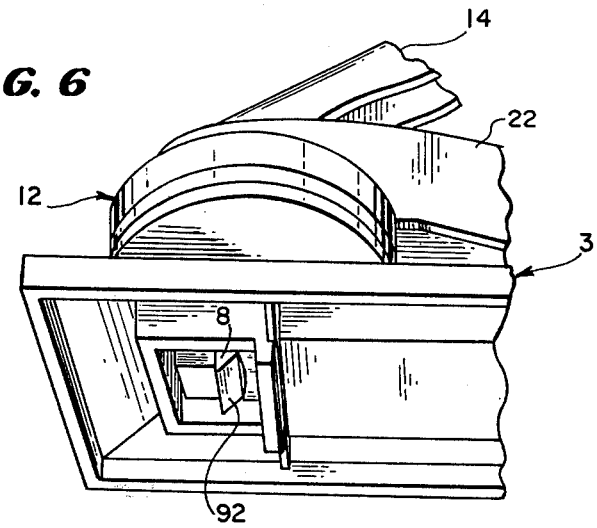
FIG. 6 is an enlarged partial perspective of the pocket seal press in the base showing the latch.
Figure 7:
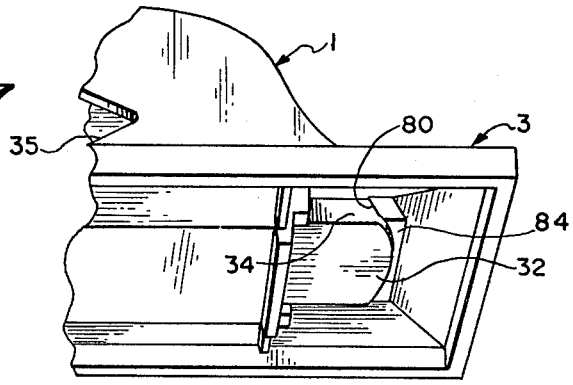
FIG. 7 is an enlarged partial perspective of the heel of the pocket seal press in the base.

The press frame 11 illustrated comprises a stamping of flat heavy sheet metal that is die formed and shaped to the U-shaped cross-section as shown in FIG. 4 wherein the upright sides 22 are parallel and the bottom 2 joining them is substantially flat and planar to provide a support and finger grip handle 26 contour. The front of the pocket seal press is recessed at 28 to form the forward edge 30 of the bottom 2 thereof. The side walls 22 at the front thereof have curved edges 36 of substantial thickness extending forward of th forward edge 30 of the bottom. At the rear or heel of the pocket seal press, the bottom 2 extends rearwardly to form a lip 32, and the side walls 22 have rear edges 34 inclined toward the lip. The front and rear of the side walls are complementary in shape to enable a series of frames to be cut as blanks from sheet metal stock.

At their front ends, the sides 22 as notched 35 to form a pair of overhanging arms 40 and a lower arm 42. The facing edges 44 and 46 of the arms define a throat T between them. The pair of overhanging arms 40 are riveted together by rigidifying spacer rivet 48 as well as the pivot pin 16 journalling the lever handle 14.

The lever 14 is a U-shaped die formed stamping, is pivotally mounted on the pin 16 and has a latch 52 mounted in a slot on top of the lever movable toward and away from a position in which the latch 52 engages the rivet 48 after the lever is pressed downwardly a predetermined distance to hold the lever in its down position to prevent separation of the pair of die elements 54. The latch 52 serves many purposes. It not only holds the lever collapsed for storage and the die elements closed against contamination, but it may be utilized to lock and be so held in locked position by the latch initially during the matrix forming of the male die element, and in use, to lift the seal by the handle and frame.

The die assembly 12 comprises the pair of die elements 54 and a die support 55 for securing the elements together at the rear thereof, the die support comprises a pair of spring blades 56. A shank 58 is provided on the upper spring blade for supporting the upper element 54 in proper orientation over the lower element 54 to insure proper mating relationship and orientation of the die characters, the top of the shank being engaged by the roller 17.

Upright teeth 62 are provided on the edges 44 of the lower arms 42 of the frame engageable with notches 64 in the lower die element to hold the embossing die assembly 12 in operative position in the throat T. Alternatively, the die assembly may be held in place by the roller 17 on the lever received in a slotted shank (not shown) carried on the die assembly as described in Priesmeyer U.S. Pat. No. 3,313,231, incorporation of which is hereby made herein by reference.

The base 3 readily receives the seal press in position for it to be used as a desk top seal press and as illustrated is integrally molded of an elastomeric material. It has sides 66 and ends 68 extending outwardly and downwardly from the recess R, the bottom 4 of the base 3 being engageable with a supporting surface such as a table top and providing a supporting area approximately three times as large as the bottom 2 of the seal press 1. The recess R in the base has spaced side walls 74 extending up from the bottom adapted supporting the side walls 22 of the seal press in vertical position when the base is positioned on a desk. The recess further has a downwardly and outwardly inclined inside end wall 80 terminating in an undercut surface 84, and an opening 86 in the bottom 4 adjacent the rear end wall, the end wall constituting the means 10 engageable with the seal press at its heel for holding the seal press in the recess. The heel of the seal press is received in the recess in an inclined swinging relation that carries it into a rigid engagement with two parallel inclined tracks 82 88 on the rear end wall that engage the edges 34 of the side walls 22 of the seal press. When fully engaged, the lip 32 of the bottom of the seal press extends under the undercut surface 84 against which it is levered with mild pressure when the bottom 2 of the seal press engages the bottom 2 of the recess.

The finger 8 for detachably securing the seal press 1 to the base 3 depends from the rearward end of the resilient hinge member 9, the resilient hinge member extending rearwardly from the forward end wall 90 of the recess R and holding the finger spaced from the forward end wall in a position in which the finger is engageable with the forward edge 30 of the bottom 2 of the seal press. The finger extends down to an inclined lower end 92 in the opening 5 at the forward end of the bottom of the recess, and has a projection 94 adapted to extend over the bottom 2 of the seal at its forward edge 30. The finger 8 is accessible through the opening 5 in the bottom of the recess and adapted to be pivoted forwardly to a position in which the forward edge 30 of the bottom of the seal press may be moved past the projection 94 on the finger to enable removal of the seal press 1 from the base 3.

In removing the seal press 1 from the base, a thumb and forefinger of one hand of the user can be placed between the front wall 68 of the base and the finger 8 and with minimum effort the finger 8 may be pivoted forwardly to move it out of engagement with the forward edge 30 of the bottom 2 of the seal press, the seal press 1 can be cammed free of the base with the other hand. To secure the seal press 1 to the base, the heel of the seal press is inserted in the opening 86 in the bottom of the recess R at the rear thereof and the front of the seal press is pivoted forward toward the bottom 4 of the recess until the forward edge 30 of the bottom of the seal press moves past the projection 94 on the finger 8.

In accordance with this invention, the side walls of the recess in the base provides sufficient support and contact against the sides 22 of the seal press that the assembly performs with full expectation of a desk top seal press. At will, it can be easily assembled with insertion and use and freed with a natural "pull apart" effort of the owner. Furthermore, the base is decorative and can be left on the desk top when the seal press is used as a pocket seal press and thereby be a reminder to remount the seal easily on the base to serve as a seal press: press when the pocket seal is returned.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In combination, a pocket seal press having a bottom and a base for supporting the seal press in an upright position, the base having a recess therein adapted to receive the bottom of the seal press with the bottom of the seal press being moved down within the recess toward the bottom of the recess for positioning it in bearing relation thereon, the bottom of the recess having an opening therein, the seal press and base having means for detachably securing the seal press to the base comprising a latch at the opening in the bottom of the recess and integral with said base, the latch normally occupying a first position for holding the bottom of the seal press in the recess in bearing relation on the bottom thereof, being accessible from beneath the base for enabling engagement of the latch by a finger of the user, being movable to a second position by application of force thereto by the finger of the user, and, when in its second position, enabling the bottom of the seal press to be moved upwardly within the recess away from the bottom thereof for removal of the seal press from the recess in the base.

2. The combination set forth in claim 1 wherein the latch comprises a finger on the base, the latch finger being engageable with the seal press.

3. The combination set forth in claim 2 wherein the recess is defined by an end wall constituting the forward end wall of the recess, the opening in the bottom of the recess being adjacent the forward end wall of the recess, the latch finger being on the forward end wall.

4. The combination set forth in claim 3 wherein the latch finger is at the end of a resilient hinge member extending from said forward end wall of the recess, said hinge holding the latch finger spaced from the forward end wall in a position in which the latch finger is engageable with the seal press.

5. The combination set forth in claim 3 wherein the latch finger has a projection adapted to extend into engagement with the seal press at the forward lower edge thereof.

6. The combination set forth in claim 5 wherein the bottom of the seal press terminates in a forward edge adapted to be engaged by the latch finger, the projection on the latch finger extending over the bottom of the seal press at its forward edge.

7. The combination set forth in claim 6 wherein the latch finger is adapted to be pivoted to a position in which the forward edge of the bottom of the seal press may be moved past the projection on the latch finger to enable removal of the seal press from the base.

8. The combination set forth in claim 5 wherein the seal press has sides extending up from the bottom and forward of the forward edge of the bottom, the latch finger extending between the sides of the seal press when in engagement with the forward edge of the bottom of the seal press.

9. The combination set forth in claim 3 wherein the securing means further comprises means at the rear end of the recess engageable with the seal press at the heel thereof for holding the seal press in the recess.

10. The combination set forth in claim 3 wherein the recess is defined by a rear end wall having an undercut surface, the seal press having a lip at its heel engageable with said undercut surface.

11. The combination set forth in claim 10 wherein the heel of the seal press is inclined toward said lip, the rear end wall of the recess having an inclined surface adapted to be engaged by the heel of the seal press.

12. The combination set forth in claim 11 wherein the bottom of the recess of the base has an opening at the rear end wall thereof.

13. The combination set forth in claim 1 wherein the base has sides and ends extending outwardly and downwardly from the recess, the bottom of the base being engageable with a supporting surface.

14. The combination set forth in claim 13 wherein the base is integrally molded of an elastomeric material.

15. A base for supporting a pocket seal press having a bottom, said base having a recess therein adapted to receive the bottom of the seal press with the bottom of the seal press being moved down within the recess toward the bottom of the recess for positioning it in bearing relation thereon, the bottom of the recess having an opening therein, and means for detachably securing the seal press to the base comprising a latch at the opening in the bottom of the recess and integral with said base, the latch normally occupying a first position in which the latch is engageable with the seal press for holding the bottom of the seal press in the recess in bearing relation on the bottom thereof in the recess of the base, being accessible from beneath the base for enabling engagement of the latch by a finger of the user, being movable to a second position by application of force thereto by the finger of the user, and, when in its second position, enabling the bottom of seal press to be moved upwardly within the recess away from the bottom thereof for removal of the seal press from the recess in the base.

16. A base as set forth in claim 15 wherein the latch comprises a finger on the base, the latch finger being engageable with the seal press.

17. A base as set forth in claim 16 wherein the recess is defined by an end wall constituting the forward end wall of the recess, the opening in the bottom of the recess being adjacent the forward end wall of the recess, the latch finger being on the forward end wall.

18. A base as set forth in claim 17 wherein the finger is at the latch end of a resilient hinge member extending from said forward end wall of the recess, said hinge holding the latch finger spaced from the forward end wall in a position in which the latch finger is engageable with the seal press.

19. A base as set forth in claim 17 wherein the latch finger has a projection adapted to engage the seal press and to extend over the forward edge of the bottom thereof.

20. A base as set forth in claim 19 wherein the latch finger is adapted to be pivoted to a position in which the forward edge of the bottom of the seal press may be moved past the projection on the latch finger to enable removal of the seal press from the base.

21. A base as set forth in claim 17 wherein the securing means further comprises means at the rear end of the recess engageable with the seal press at the heel thereof for holding the seal press in the recess.

22. A base as set forth in claim 17 wherein the seal press has a lip at its heel, and wherein the recess is defined by a rear end wall having an undercut surface engageable by the lip of the seal press.

23. A base as set forth in claim 22 wherein the heel of the seal press is inclined toward said lip, and wherein the rear end wall of the recess has an inclined surface engageable by the heel of the seal press.

24. A base as set forth in claim 23 wherein the bottom of the recess of the base has an opening at the rear end wall thereof.

25. A base as set forth in claim 15 wherein the base has sides and ends extending outwardly and downwardly from the recess, the bottom of the base being engageable with a supporting surface.

26. A base as set forth in claim 15 wherein the base is integrally molded of an elastomeric material.

* * * * *